US005243727A

United States Patent [19]

Tanaka et al.

[11] Patent Number: 5,243,727

[45] Date of Patent: Sep. 14, 1993

[54] FLOOR POLISHER

[75] Inventors: Osamu Tanaka, Yokaichi; Tsutomu Morita, Osaka; Kazutoshi Kinoshita, Mukou, all of Japan

[73] Assignee: Matsushita Electric Industrial Co., Ltd., Osaka, Japan

[21] Appl. No.: 856,080

[22] PCT Filed: Sep. 12, 1991

[86] PCT No.: PCT/JP91/01208

§ 371 Date: May 29, 1992

§ 102(e) Date: May 29, 1992

[87] PCT Pub. No.: WO92/04853

PCT Pub. Date: Apr. 2, 1992

[30] Foreign Application Priority Data

Sep. 14, 1990 [JP] Japan ..... 2-96785

[51] Int. Cl.[5] ..... B24B 29/00; A47L 11/164; A47L 11/282

[52] U.S. Cl. ..... 15/98; 15/49.1; 15/180; 15/230; 51/177; 403/328

[58] Field of Search ..... 15/28, 29, 49.1, 50.1, 15/50.2, 52.2, 87, 98, 180, 230, 385, 93.1; 403/327, 328; 51/170 T, 171; 299/41

[56] References Cited

U.S. PATENT DOCUMENTS

| | | | |
|---|---|---|---|
| 244,280 | 7/1881 | McVay | 15/50.1 |
| 814,020 | 3/1906 | Clifford | 403/328 |
| 4,917,442 | 4/1990 | Johnson | 403/328 |

FOREIGN PATENT DOCUMENTS

| | | | |
|---|---|---|---|
| 1063397 | 12/1953 | France | 15/28 |
| 43-22614 | 9/1968 | Japan . | |
| 47-14937 | 5/1972 | Japan . | |
| 55-48503 | 11/1980 | Japan . | |
| 57-20022 | 4/1982 | Japan . | |
| 63-132315 | 8/1988 | Japan . | |
| 56645 | 7/1944 | Netherlands | 15/180 |

*Primary Examiner*—Edward L. Roberts
*Attorney, Agent, or Firm*—Wenderoth, Lind & Ponack

[57] ABSTRACT

A floor polisher of the present invention is provided with a main body having a motor incorporated therein, and a driving shaft coupled to the motor and protruding out below the bottom face of the main body. A front end of the driving shaft is polygonal, and a stepped portion is formed in the outer periphery thereof. Moreover, a rotary cleaner unit is detachably mounted to the driving shaft, which is provided with a polygonal axial hole to be engaged with the polygonal end part of the driving shaft. A lever is provided to engage with the stepped portion of the driving shaft to thereby prevent the rotary cleaner unit from shipping off the shaft. The lever is slidable forward and backward, is urged toward the stepped portion, and has an inclined face formed at its front end.

12 Claims, 5 Drawing Sheets

Fig.8 - PRIOR ART
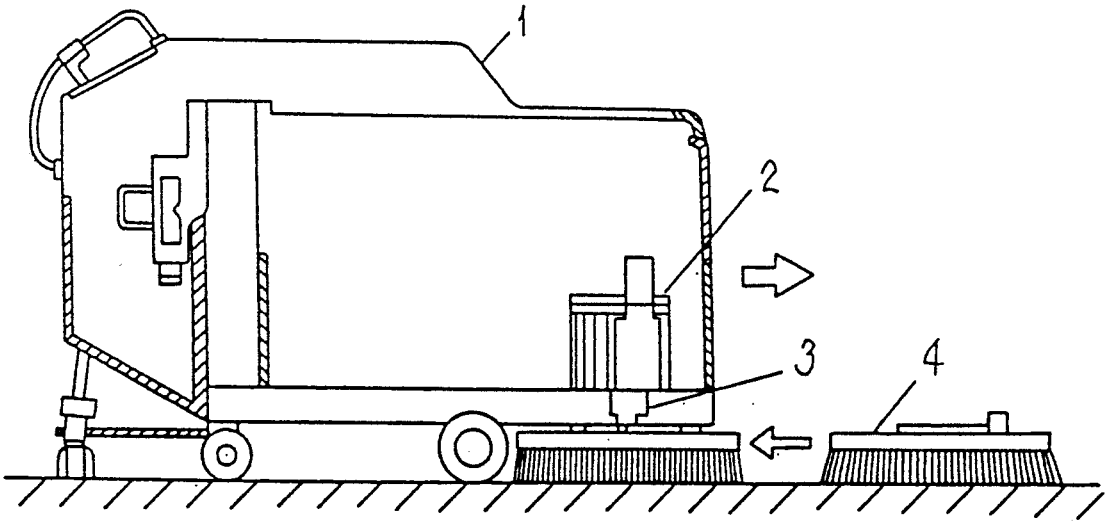

Fig. 9 - PRIOR ART
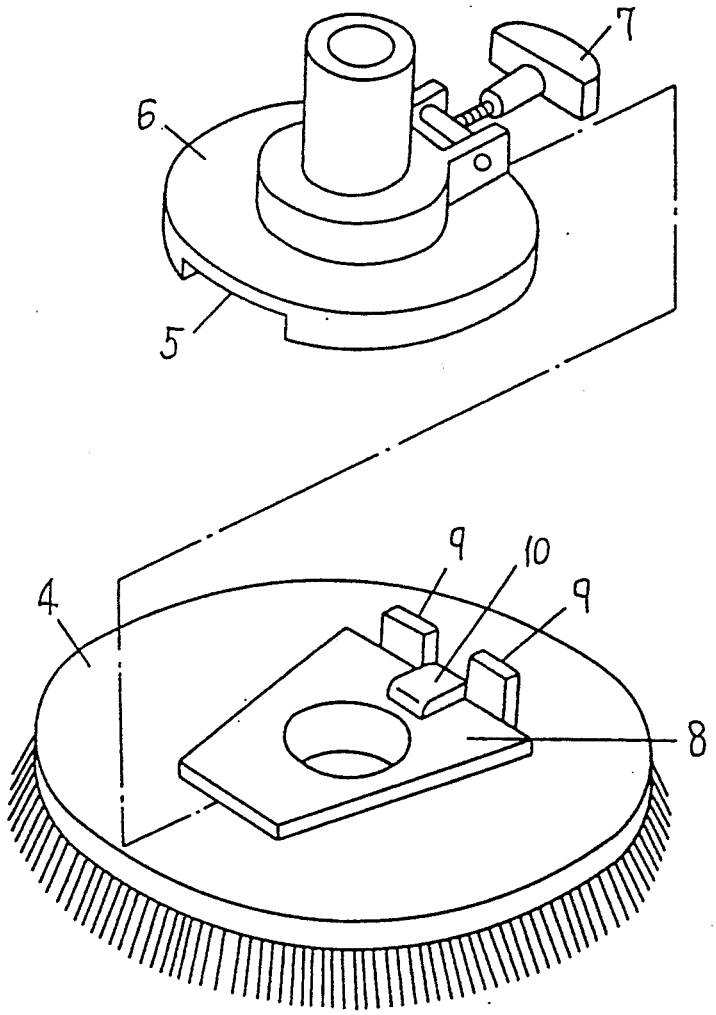

FLOOR POLISHER

BACKGROUND OF THE INVENTION

1. Field of the Invention

The present invention relates to a floor polisher equipped with several kinds of rotary cleaner units exchangeable in accordance with the cleaning purpose, and more particularly to an arrangement for mounting the rotary cleaner units.

2. Description of the Prior Art

The rotary cleaner units of a floor polisher tend to become dirty frequently and thus must be exchanged frequently. Therefore various kinds of methods have been proposed for the exchange of the devices, for example, as disclosed in Japanese Utility Model Laid-open Publication Jikkaisho 62-33757 (33757/1987).

More specifically, referring to FIGS. 8 and 9, a main body 1 of the conventional floor polisher has a brush motor 2 built thereinside. A rotary shaft 3 of the brush motor 3 protrudes out of the bottom face of the main body 1, so that a rotary cleaning device 4 can be detachably mounted to the floor polisher.

A mounting flange 6 with a dovetail groove 5 and, a turnable lock lever 7 are provided at the bottom face of the main body 1. A connecting plate 8, engaging parts 9 and a pressing part 10 are arranged on the upper face of the rotary cleaning device 4.

In the above-described structure, when the rotary cleaning device 4 is to be mounted, while the lock lever 7 is raised and the engaging parts 9 are held open, the rotary cleaning device 4 is slipped into position below the main body 1. Then, the lock lever 7 is turned to thereby fasten the connecting plate 8 fitted into the dovetail groove 5 of the flange 6.

According to the conventional method described above, it is necessary to turn the lock lever at the floor side of the main body of the cleaner so as to engage the rotary cleaning device. The operation is not only inconvenient from a sanitary viewpoint, but is considerably troublesome since it necessitates manipulation of the lock lever which cannot be seen by the operator.

SUMMARY OF THE INVENTION

The object of the present invention is therefore to provide a floor polisher for which rotary cleaner unit can be easily exchanged so as to save labor when the rotary cleaner units are mounted or detached.

In order to accomplish the aforementioned object, according to the present invention, a floor polisher is provided with a motor incorporated therein, a driving shaft connected to the motor and protruding from the bottom face of a main body of the cleaner, and a rotary cleaner unit detachably mounted to the driving shaft. The driving shaft is formed to have polygonally-shaped front end, with a step formed in the outer periphery thereof. On the other hand, the rotary cleaner unit has a polygonal axial hole to be engaged with the polygonal end of the driving shaft, and a lever to be engaged with the stepped portion of the driving shaft to thereby prevent the rotary cleaning device from slipping off the shaft. The lever is freely slidable forward and backward, is urged in the direction of the stepped portion, and has an inclined surface formed at its front end.

According to a further aspect of the floor polisher of the present invention, the axial hole of the rotary cleaner unit is formed in the inner face of a cylindrical boss, and a radially extending cut-out is formed in the boss to meet with an upper portion of the axial hole to allow the driving shaft to be inserted in a radial direction into the axial hole. Therefore, the floor polisher of the present invention becomes more convenient for use.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 8 is a schematic cross-sectional view of a conventional floor polisher; and FIG. 9 is an essential perspective view of the floor polisher of FIG. 8.

DETAILED DESCRIPTION OF THE PREFERRED EMBODIMENTS

Figure 1:
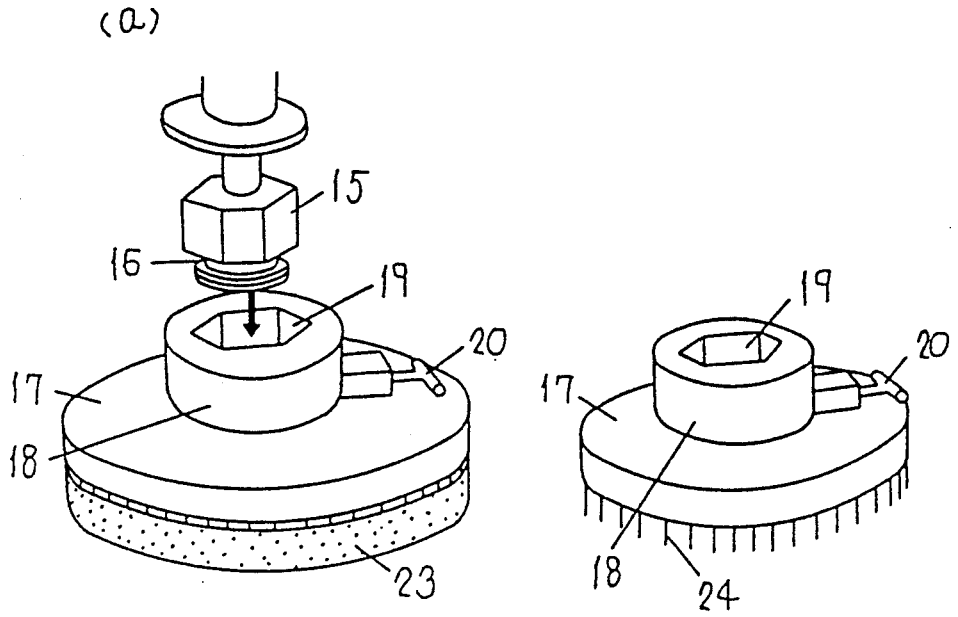
FIG. 1 is a perspective view of a rotary cleaner unit of a floor polisher according to one embodiment of the present invention.
Figure 2:
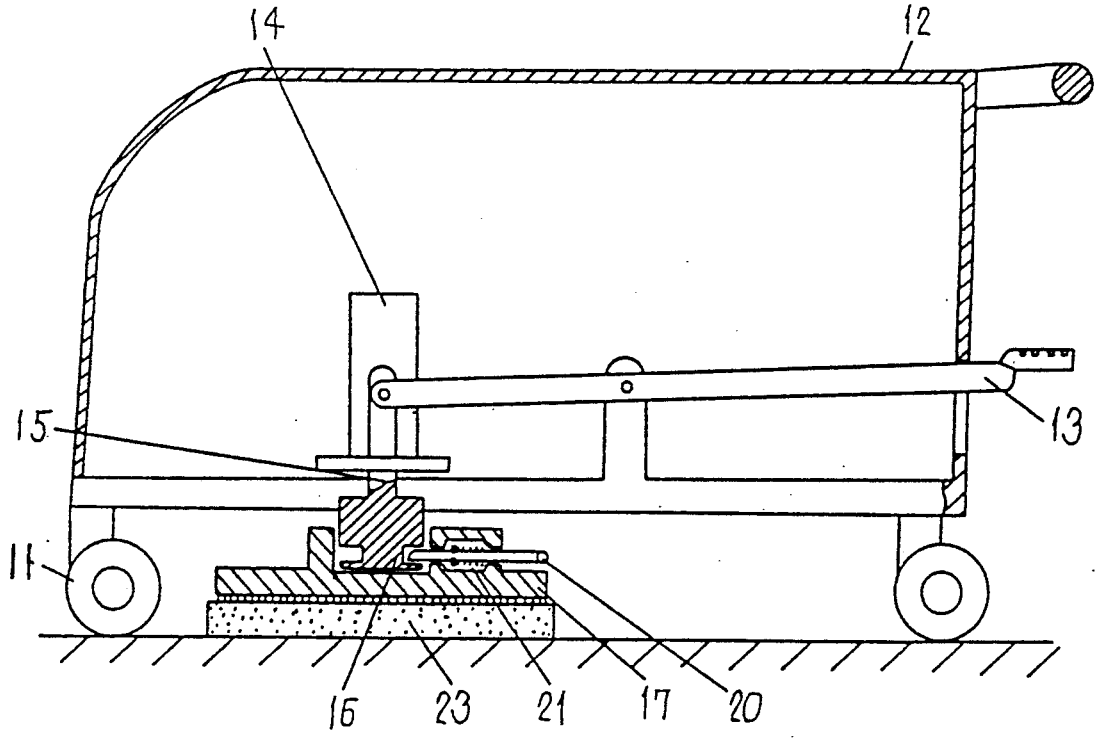
FIG. 2 is a cross-sectional view of the whole of the floor polisher of FIG. 1.
Figure 3:
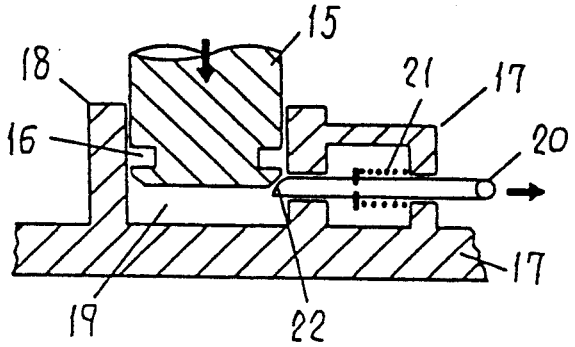
FIGS. 3, 4 and 5 are cross sectional views explanatory of the mounting/detaching process of the rotary cleaner unit.
Figure 4:
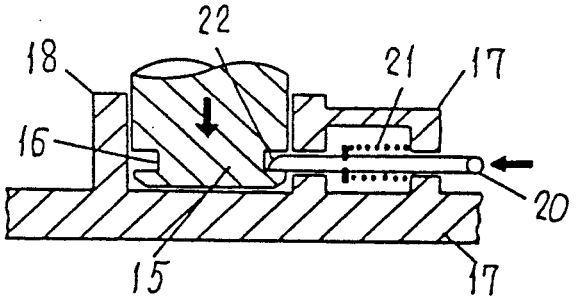
Figure 5:
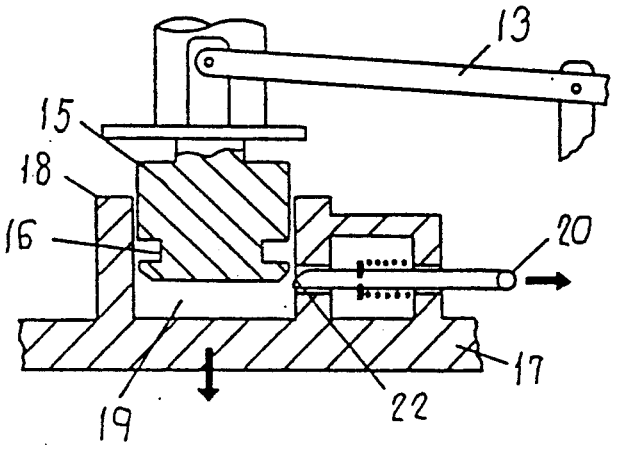

Referring to FIGS. 1 through 5, a main body 12 of a floor polisher with moving wheels 11 has a motor 14 incorporated thereinside. The motor 14 is moved up and down via a lift mechanism 13. A driving shaft 15 directly coupled to the motor 14 protrudes out of the bottom face of the main body 12.

As shown in the drawings, an end part of the driving shaft 15 is polygonal, e.g., hexagonal, with a groove-like stepped portion 16 formed in the outer periphery thereof.

Meanwhile, a rotary cleaner unit 17 mounted to the driving shaft 15 has a polygonal axial hole 19 formed in a central boss 18. A lever 20 orthogonal to the axial hole 19 is slidable forward and backward in the outer peripheral part of the boss 18. An end part of the lever 20 is normally engaged with the stepped portion 16 of the driving shaft 15 to thereby prevent slip-off of the rotary cleaner unit 17 from slipping off the driving shaft 15.

The lever 20 is urged in the advancing direction by a spring 21, and an inclined face 22 is formed at the front end of the lever 20. The inclined face 22 is inclined upwardly and in a direction in which the lever 20 is retracted by the pressing force of the driving shaft 15.

In the structure of the floor polisher as described hereinabove, the rotation of the motor 14 is transmitted to the rotary cleaner unit 17 from the polygonal part of the driving shaft 15 via the polygonal axial hole 19.

The rotary cleaner unit 17 can be mounted to the driving shaft 15 by merely pressing the axial hole 19 of the unit 17 into the driving shaft 15. In other words, when the axial hole 19 is engaged on the driving shaft 15 and the rotary cleaner unit 17 is pushed, the front end of the driving shaft 15 butts against the inclined face 22, and the lever 20 is forced rearwardly against the bias of spring 21. Then, when the lever 20 reaches the stepped portion 16, it is advanced by the action of the spring 21, so that the front end of the lever is engaged in the stepped portion 16.

If the motor 14 is made suitably heavy, the driving shaft 15 can be inserted into the axial hole 19 by its own weight by merely fitting the axial hole 19 into the driving shaft 15 and lowering the motor 14 via the lift mechanism 13.

When the cleaner unit 17 is to be detached, it is enough to pull the unit 17 off the shaft 15 while the lever 20 is retracted.

In the manner discussed above, the rotary cleaner unit 17 can be mounted/detached to and from the floor polisher with ease. Particularly, the rotary cleaner unit 17 can be positively mounted even in a narrow space only by merely inserting the cleaner unit 17 onto the shaft 15.

A non-woven pad 23 as shown in FIG. 1(*a*), a brush 24 as shown in FIG. 1 (*b*) or the like may be attached to the rotary cleaner unit, which can be easily exchanged upon necessary.

Figure 6:
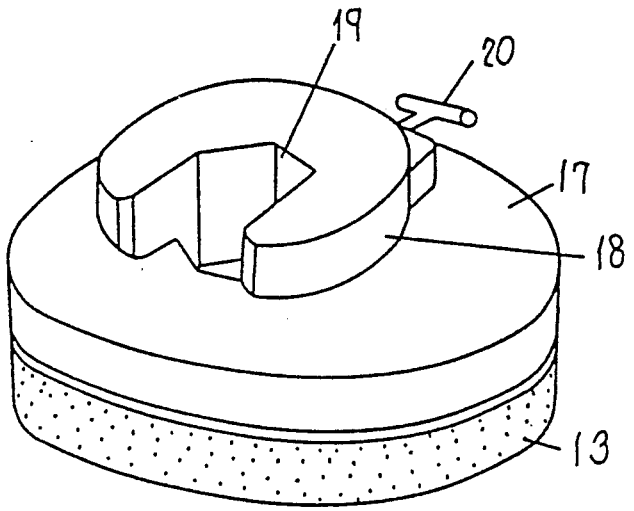
FIGS. 6 and 7 are perspective views of a rotary cleaner unit of a floor polisher according to a further embodiment of the present invention.
Figure 7:
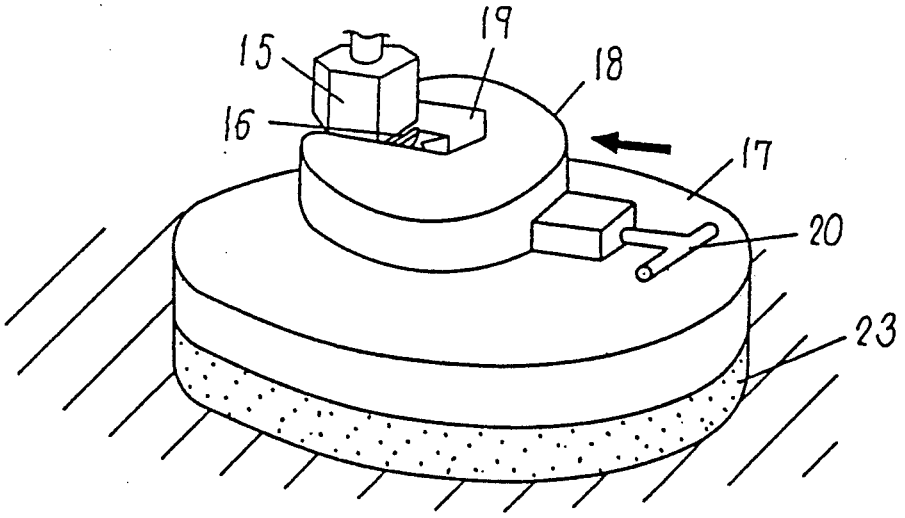

In FIGS. 6 and 7, a part of the boss 8 is notched so that the axial hole 19 opens through a periphery of the boss 8, thereby causing an upper portion of the axial hole to be opened in a radial direction.

In the structure indicated in FIGS. 6 and 7, when the rotary cleaner unit 17 is moved laterally to fit the driving shaft 15 into the axial hole 19, and then lifted slightly (or the driving shaft 15 is lowered), the rotary cleaner unit 17 can be completely mounted. Therefore, manipulation of the rotary cleaner unit becomes easier.

As has been fully described hereinabove, according to the arrangement of the present invention, the rotary cleaner unit of the floor polisher can be mounted by merely inserting the driving shaft into the axial hole without manipulating the lever below the floor polisher. Therefore, the present invention enables sanitary and easy cleaning.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A floor polisher comprising:

a main body having a bottom wall;

a motor mounted in said main body and having a driving shaft protruding downwardly through said bottom wall, said driving shaft having a bottom end formed with a polygonal shape and a notch in an outer periphery thereof;

a lift mechanism mounted in said main body and being operably coupled with said driving shaft for selectively lifting and lowering said driving shaft;

a rotary cleaner unit detachably mounted to said driving shaft for rotation therewith about a rotation axis and having a polygonally shaped axial hole which is complementary in shape to said bottom end of said driving shaft, said bottom end of said driving shaft being detachably engaged in said axial hole of said rotary cleaner unit;

an engagement lever slidably mounted to said rotary cleaner unit for slidable movement in a radial direction toward and away from said rotation axis; and biasing means for urging said engagement lever toward said rotation axis and causing a radially inner end of said engagement lever to automatically engage in said notch formed in said driving shaft when said driving shaft is moved into said axial hole of said rotary cleaner unit.

2. A floor polisher as recited in claim 1, wherein said bottom end of said driving shaft has an upwardly and radially outwardly inclined portion; and said radially inner end of said engagement lever has an upwardly and radially outwardly inclined portion for sliding engagement with said inclined portion of said bottom end of said driving shaft when said driving shaft is moved into said axial hole of said rotary cleaner unit.

3. A floor polisher as recited in claim 1, wherein said lift mechanism comprises a lift lever having a first end operably coupled with said driving shaft, a second end constituting a handle for grasping by an operator and an intermediate portion pivotably mounted to said main body for pivotal movement in a vertical plane.

4. A floor polisher as recited in claim 1, wherein said engagement lever has a radially outer end protruding radially outwardly from an outer periphery of said rotary cleaner unit at a predetermined vertical position, said outer periphery through which said engagement lever extends being an outermost outer periphery of said rotary cleaner unit at said predetermined vertical position, such that said radially outer end of said engagement lever can be grasped by an operator to pull said engagement lever radially outwardly against said biasing means to disengage said radially inner end of said engagement lever from said notch of said driving shaft.

5. A floor polisher as recited in claim 1, wherein said rotary cleaner unit includes an upwardly protruding boss portion through which at least a portion of said axial hole extends; and said engagement lever is slidably mounted radially through said boss portion from an outer periphery thereof into said axial hole.

6. A floor polisher as recited in claim 1, wherein said rotary cleaner unit includes an upwardly protruding boss portion through which an upper portion of said axial hole extends; and a cut-out is formed radially through said boss portion from an outer periphery thereof and into said axial hole, said cut-out being sufficiently large to constitute a means for allowing said bottom end of said driving shaft to be inserted in a radial direction into said axial hole.

7. A floor polisher as recited in claim 6, wherein said cut-out has a vertical height which is less than a vertical height of said axial hole.

8. A floor polisher comprising:

a main body having a bottom wall;

a motor mounted in said main body and having a driving shaft protruding downwarldy through said bottom wall, said driving shaft having a bottom end formed with a polygonal shape and a notch in an outer periphery thereof;

a rotary cleaner unit detachably mounted to said driving shaft for rotation therewith about a rotation axis and having a polygonally shaped axial hole which is complementary in shape to said bottom end of said driving shaft, said bottom end of said driving shaft being detachably engaged in said axial hole of said rotary cleaner unit;

an engagement lever slidably mounted to said rotary cleaner unit for slidable movement in a radial direction toward and away from said rotation axis;

biasing means for urging said engagement lever toward said rotation axis and causing a radially inner end of said engagement lever to automatically engage in said notch formed in said driving shaft when said driving shaft is moved into said axial hole of said rotary cleaner unit; and wherein said engagement lever has a radially outer end protruding radially outwardly from an outer periphery of said rotary cleaner unit at a predetermined vertical position, said outer periphery through which said engagement lever extends being an outermost outer periphery of said rotary cleaner unit at said predetermined vertical position, such that said radially outer end of said engagement lever can be grasped by an operator to pull said engagement lever radially outwardly against said biasing means to disengage said radially inner end of said engagement lever from said notch of said driving shaft.

9. A floor polisher as recited in claim 8, wherein said rotary cleaner unit includes an upwardly protruding boss portion through which at least a portion of said axial hole extends; and said engagement lever is slidably mounted radially through said boss portion from an outer periphery thereof into said axial hole.

10. A floor polisher as recited in claim 8, wherein said bottom end of said driving shaft has an upwardly and radially outwardly inclined portion; and said radially inner end of said engagement lever has an upwardly and radially outwardly inclined portion for sliding engagement with said inclined portion of said bottom end of said driving shaft when said driving shaft is moved into said axial hole of said rotary cleaner unit.

11. A floor polisher as recited in claim 8, wherein said rotary cleaner unit includes an upwardly protruding boss portion through which an upper portion of said axial hole extends; and a cut-out is formed radially through said boss portion from an outer periphery thereof and into said axial hole, said cut-out being sufficiently large to constitute a means for allowing said bottom end of said driving shaft to be inserted in a radial direction into said axial hole.

12. A floor polisher as recited in claim 11, wherein said cut-out has a vertical height which is less than a vertical height of said axial hole.

* * * * *